US006975824B2

(12) United States Patent
Park

(10) Patent No.: US 6,975,824 B2
(45) Date of Patent: Dec. 13, 2005

(54) WET ELECTROPHOTOGRAPHIC PRINTER

(75) Inventor: Woo-Yong Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/625,612

(22) Filed: Jul. 24, 2003

(65) Prior Publication Data

US 2004/0146317 A1 Jul. 29, 2004

(30) Foreign Application Priority Data

Oct. 11, 2002 (KR) ..... 10-2002-0062045

(51) Int. Cl.[7] ..... G03G 15/10
(52) U.S. Cl. ..... 399/237
(58) Field of Search ..... 399/237, 238, 399/239, 249

(56) References Cited

U.S. PATENT DOCUMENTS 5,561,264 A * 10/1996 Iino et al. ..... 399/249 X
6,035,165 A * 3/2000 Watanabe ..... 399/239
6,038,421 A * 3/2000 Yoshino et al. ..... 399/239
6,108,508 A * 8/2000 Takeuchi et al. ..... 399/238
6,353,721 B1 * 3/2002 Yamaguchi et al. ..... 399/237
6,385,421 B1 * 5/2002 Imamiya et al. ..... 399/237
6,405,008 B1 * 6/2002 Obu et al. ..... 399/237
6,466,757 B2 * 10/2002 Itaya et al. ..... 399/249
6,636,716 B2 * 10/2003 Yoshino ..... 399/239

* cited by examiner

*Primary Examiner*—Sandra L. Brase
(74) *Attorney, Agent, or Firm*—Staas & Halsey LLP

(57) ABSTRACT

A wet electrophotographic printer includes a developing chamber communicating with an inlet of a first nip between a developing roller and a deposit roller to supply a liquid developer into the first nip therebetween, a developer storing chamber communicating with an inlet of a second nip between the developing roller and a metering roller to withdraw the liquid developer of a low density generated at the second nip during a development, and preventing the liquid developer of the low density from being supplied to the first nip, and a developer supply unit disposed below a partition to supply the liquid developer from the developer storing chamber into the developing chamber. The liquid developer of the low density generated at the second nip is not directly supplied to the first nip, but is supplied after being withdrawn to the developer storing chamber and mixed therein.

18 Claims, 6 Drawing Sheets

WET ELECTROPHOTOGRAPHIC PRINTER

CROSS-REFERENCE TO RELATED APPLICATION

This application claims the benefit of Korean Application No. 2002-62045, filed Oct. 11, 2002, in the Korean Intellectual Property Office, the disclosure of which is incorporated herein by reference.

BACKGROUND OF THE INVENTION

1. Field of the Invention

The present invention relates to a wet electrophotographic printer using a high density liquid developer, and more particularly, to a wet electrophotographic printer having a developing unit constructed so that an inlet of a nip between a developing roller and a metering roller communicates with a developer storing chamber to uniformly supply an appropriate high density liquid developer on a photosensitive body such as a photosensitive drum forming a visible developer image during a development.

2. Description of the Related Art

In general, an electrophotographic printer obtains a desired image by forming an electrostatic latent image on a photosensitive medium or photosensitive body such as a photosensitive belt or a photosensitive drum, developing the electrostatic latent image by using developers having predetermined colors, and transferring the developed electrostatic latent image to a paper. Electrophotographic printers are divided into wet type and dry type electrophotographic printers according to kinds of developers used therewith. The wet electrophotographic printer uses a liquid developer obtained by mixing a volatile liquid carrier with a powder type toner.

Since the wet electrophotographic printer using the liquid developer uses toner particles having a grain size less than about 0.5 to 5 $\mu$m, a higher quality image is obtainable for the wet electrophotographic printer than that of the dry electrophotographic printer using only the powder type toner in the development of the electrostatic latent image, and further, the wet electrophotographic printer prevents damage due to harmful toner dust. Therefore, the wet electrophotographic printer has gradually become popular to use.

However, the wet electrophotographic printer generally obtains an appropriate image density by using a low density liquid developer, which is below 3% solid. Accordingly, a complicated developer delivery system to sufficiently supply the liquid developer to developing regions of developing units and to collect the liquid developer is required to obtain the appropriate image density, thereby increasing a size of the developing unit and complicating the wet electrophotographic printer.

Further, an apparatus to control a density of the liquid developer is necessary to obtain the appropriate image density when replenishing the liquid developer due to variations of toner grains after the development.

Thus, the developer delivery system needs to be removed or to be simplified so as to prevent the wet electrophotographic printer from being oversized or being complicated. Accordingly, the wet electrophotographic printer using a high density liquid developer, which is over 3% solid, has been popularly used rather than a low density liquid developer, which is less than 3% solid.

FIG. 1 is a schematic view illustrating a general wet electrophotographic printer 1 using a high density liquid developer.

The wet electrophotographic printer 1 includes a photosensitive body 9 such as an organic photoconductive (OPC) drum, a laser scanning unit 11, a charging roller 12, a developing unit 13, a transfer belt 10 moving in a form of a caterpillar, primary and secondary rollers 21 and 22 rotating the transfer belt 10 in the form of the caterpillar, a first transfer roller 8 transferring a developer image to the transfer belt 10, a second transfer roller 23 transferring the developer image to a paper P, a fixing roller 25 fixing the developer image, and a cleaning blade 51 removing a residual developer image remaining on the transfer belt 10. The above-described elements of the wet electrophotographic printer sequentially perform an image formation process including a charging operation, an exposure operation, a development operation, a transfer operation and a fixation operation by mutual operations, to form a desired image on the paper P.

For color printing, the wet electrophotographic printer 1 includes four laser scanning units 11, and four developing units 13 each individually containing a high density liquid developer 48, each of which is of 3 to 40% solid and is of a different color, namely, the four individual high density liquid developers being, respectively, black, yellow, cyan and magenta in a color thereof.

Each of the developing units 13 includes a developing chamber 6 storing the high density liquid developer 48, a developing roller 7 positioned below the photosensitive body 9, a deposit roller 14 installed below the developing roller 7 to transmit an electric charge to the liquid developer 48 to form a charged developer layer on the developing roller 7, a metering roller 15 transmitting a predetermined voltage to the charged developer layer formed on the developing roller 7 by the deposit roller 14 to transfer a large volume of toner to the developing roller 7, and restricting the charged developer layer to have a predetermined amount or density (% solid) of the toner to supply into a nip between the developing roller 7 and the photosensitive body 9, and a cleaning roller 16 cleaning the developing roller 7.

The deposit roller 14 and the metering roller 15 serve to supply the predetermined toner amount or density of the charged developer layer into the nip between the developing roller 7 and the photosensitive body 9, regardless of the amount or the density of the solid, which is in a range of about 3 to 40% solid of the liquid developer 48.

To supply the liquid developer 48 to the developing chamber 6, disposed below each of the developing units 13 is a developer supply unit 28, 30.

Each of the developer supply units 28, 30 comprises a developer cartridge 28 connected to an inlet and an outlet formed, respectively, at a bottom and a side of the developing chamber 6 through connecting tubes 29 and serving as a developer storing chamber, and a pump 30 installed in each of the connecting tubes 29 positioned between the developer cartridge 28 and the inlet of the developing chamber 6.

Each of the developer cartridges 28 is coupled to a respective connecting tube 29 by a coupler (not shown) to facilitate during and exchange of the cartridge an attachment and a detachment thereof.

Operation of the wet electrophotographic printer 1 will now be explained.

According to a print command, an electric charge layer, namely an electrostatic latent image corresponding to an image to be printed is formed on the photosensitive body 9 by the charging roller 12 and the laser scanning unit 11 and then, a developer layer having a predetermined amount of toner formed on the developer roller 7 from the liquid developer 48 of the developing chamber 6 by the deposit roller 14 and the metering roller 15 is transferred to the electrostatic latent image, thereby forming a developer image.

Further, the liquid developer 48 is formed as a charged developer layer on the developing roller 7 due to an electric charge from the deposit roller 14, and formed as the developer layer having the predetermined amount of toner on the developing roller 7 by a predetermined voltage from the metering roller 15.

Further, the pump 30 supplies the liquid developer 48 into the developing chamber 6 from the developer cartridge 28 so that the developing chamber 6 overflows with the liquid developer 48 and the liquid developer 48, which is above a predetermined level, is withdrawn into the connecting tube 29 connected to the outlet of the developing chamber 6.

Accordingly, the liquid developer 48 is always maintained at the predetermined level in the developing chamber 6.

Thus, the developer image formed on the photosensitive body 9 by the developing unit 13 is transferred from the photosensitive body 9 to the transfer belt 10 by a voltage and a pressure of the first transfer roller 8 positioned inside the transfer belt 10. Since the transfer belt 10 rotates by the primary and secondary rollers 21 and 22, the image transferred to the transfer belt 10 is moved to the second transfer roller 23 and is subsequently transferred to the paper P by a voltage and a pressure of the second transfer roller 23.

The developer image transferred to the paper P is fixed to the paper P by the fixing roller 25 and a fixing backup roller 26, thereby forming the desired image.

After the developer image is transferred from the transfer belt 10 to the paper P, the transfer belt 10 continuously rotates by the primary and secondary rollers 21 and 22 and moves to the cleaning blade 51 installed to contact an image formation surface of the transfer belt 10 at a side of the primary roller 21. Further, remnants of the developer not transferred to the paper P (generally 90 to 98% of the developer is transferred to the paper P) are removed from the image formation surface of the transfer belt 10 by the cleaning blade 51 for succeeding image printing, and are collected in a used developer storing unit 52.

The transfer belt 10, from which the remnants of the developer are removed, repeats the aforementioned procedure to perform a subsequent electrostatic latent image formation and a subsequent development through the photosensitive body 9, the laser scanning unit 11 and the developing unit 13.

However, in the conventional wet electrophotographic printer 1, since the developer cartridge 28 of the developer supply unit 28, 30 is connected to the developing chamber 6 through the connecting tubes 29 to supply the liquid developer 48 thereto, the connecting tubes 29 may be clogged if the liquid developer 48 dries in the connecting tubes 29 and adheres thereto.

When the connecting tubes 29 are clogged as described above, the supply of the liquid developer 48 to the developing unit 13 is inefficient, thereby a quality of the developer image deteriorates. At worst, the developing unit 13 directly connected to the connecting tubes 29 is impossible to operate. In this case, all component parts including the developing unit 13 should be replaced by new component parts.

Further, to stably withdraw the liquid developer 48 overflowing from the developing chamber 6 into the developer cartridge 28 through the connecting tubes 29, the developer supply unit 28, 30 should be designed so that a free fall distance of the liquid developer 48 is maintained above a given range.

Further, since the developer cartridge 28 is attached and detached to the connecting tubes 29 by the coupler, exchanging of the developer cartridge 28 is troublesome, and if careless, the liquid developer 48 can flow out from the developer cartridge 28.

Since the pump 30 is relatively high-priced and used to supply the liquid developer 48 to the developing chamber 6, the manufacturing cost is increased.

Since each of the component parts, such as the developer cartridge 28, the developing unit 13 and the photosensitive body 9, which are disposed adjacent to each other, is constructed to be separately replaced, it is troublesome that the component parts are separately assembled and disassembled when problems related with the assembly as a whole occurs or that the component parts having almost identical life span are simultaneously replaced occurs.

To improve these problems, a wet electrophotographic printer 1' having a single body developing unit 13' in which a developing chamber and a developer cartridge are horizontally disposed and unified in a body so that a pump to supply a liquid developer is not required and replacement of individual component parts is not necessary as shown in FIG. 2.

In the wet electrophotographic printer 1', a transfer belt 10' is vertically disposed by primary and secondary rollers 21' and 22' installed in a longitudinally spaced-apart relation with each other to facilitate a disposal of remnants of developer remaining on the transfer belt 10' after transferring a developer image to paper P and to prevent the remnants of the developer from moving to opposite ends of the primary roller 21' and thereby contaminating the primary roller 21', the transfer belt 10' and other components of the wet electrophotographic printer 1'.

The wet electrophotographic printer 1' includes a first transfer roller 8' transferring a developer image to the transfer belt 10', a second transfer roller 23' transferring the developer image to a paper P, a fixing roller 25' fixing the developer image, and a cleaning blade 51' removing a residual developer image remaining on the transfer belt 10'. Further, remnants of the developer not transferred to the paper P are removed from the image formation surface of the transfer belt 10' by the cleaning blade 51' for succeeding image printing, and are collected in a used developer storing unit 52'.

The developer image transferred to the paper P is fixed to the paper P by the fixing roller 25' and a fixing backup roller 26', thereby forming the desired image.

To form a developer image of four colors, namely black, yellow, cyan and magenta, four image forming parts are installed at a side of the transfer belt 10'. Each of the image forming parts comprises a laser scanning unit 11' horizontally disposed at a side of a photosensitive body 9' to form an electrostatic latent image corresponding to an image to be printed according to an image signal, and the single body developing unit 13' horizontally disposed below the photosensitive body 9' to transfer a liquid developer 48' to the electrostatic latent image formed on the photosensitive body 9' to form the developer image.

As shown in FIG. 3, disposed about the photosensitive body 9' are a discharging lamp 17, a corona charger 18, and a photosensitive body cleaner 19 having a cleaning blade 20 to clean the used remnants of the developer remaining on the photosensitive body 9' after transferring the developer image from the photosensitive body 9' to the transfer belt 10', and a used developer reservoir 23.

The single body developing unit 13' horizontally disposed below the photosensitive body 9' comprises a developing chamber 6' having a developing roller 7', a deposit roller 14', a metering roller 15', and a cleaning roller 16' installed therein; a developer storing chamber 28' formed to horizontally extend and serving as a developer cartridge storing the liquid developer 48'; and a sponge roller 32 disposed to contact with a lower portion of partition 31 to divide the developing chamber 6' and the developer storing chamber 28' and to supply the liquid developer 48' from the developer storing chamber 28' to the developing chamber 6'.

When the sponge roller 32 rotates and is in compressive contact with the lower portion of the partition 31, the liquid developer 48' absorbed by the sponge roller 32 in the developer storing chamber 28' is moved into the developing chamber 6', and then is discharged into the developing chamber 6', so that the liquid developer 48' is supplied from the developer storing chamber 28' to the developing chamber 6'.

Thus, when the liquid developer 48' is excessively supplied into the developing chamber 6' by a rotation of the sponge roller 32, the liquid developer 48' overflows a top end portion of the partition 31 and is withdrawn back into the developer storing chamber 28'.

In the wet electrophotographic printer 1', since the single body developing unit 13' has a structure in which the developing chamber 6' and the developer storing chamber 28' are unified in a body thereof, component parts are not separately assembled and disassembled in a replacement thereof, compared with the conventional wet electrophotographic printer 1. However, the wet electrophotographic printer 1' presents a problem that the liquid developer 48' having a high density stagnates in the developer storing chamber 28' to form sediments of the toner contained therein on a bottom of the developer storing chamber 28', since the developer storing chamber 28' is formed to be horizontally and widely extended.

When the toner precipitates on the bottom of the developer storing chamber 28', the density of the liquid developer 48', which is formed as the charged developer layer on the developing roller 7' due to an electric charge from the deposit roller 14' in a vicinity of the deposit roller 14' after moving from the developer storing chamber 28' to the developing chamber 6', is uneven according to a degree of precipitation of the toner, thereby a quality of the developer image formed during a development varies.

Therefore, to prevent the precipitation problem, an agitator needs to agitate the liquid developer 48' in the developer storing chamber 28', thereby manufacturing costs are increased.

Since the developer storing chamber 28' is constructed to be horizontally and widely extended, a developer level of the liquid developer 48' in the developer storing chamber 28' may be lower than a top height of the sponge roller 32 even though the liquid developer 48' is only slightly consumed.

In this case, when rotated, the sponge roller 32 absorbs air in the developer storing chamber 28' and moves the absorbed air into the developing chamber 6'. Accordingly, when the sponge roller 32 is in compressive contact with the lower portion of the partition 31, the air absorbed by the sponge roller 32 in the developer storing chamber 28' is discharged as air bubbles into the developing chamber 6'.

Thus, when the air bubbles form in the developing chamber 6', the charged developer layer, which forms on the developing roller 7' by the electric charge from the deposit roller 14' in the vicinity of the deposit roller 14', is uneven due to the air bubbles, thereby the quality of the developer image formed during the development varies.

Also, in the conventional wet electrophotographic printer 1', since the metering roller 15' is disposed in the developing chamber 6', the liquid developer having a low density generated when the liquid developer 48' is formed as the predetermined toner amount of developer layer on the developing roller 7 by a compression of the metering roller 15, may flow down from the metering roller 15 and may be directly supplied to the deposit roller 14'.

Thus, when the liquid developer of the low density is supplied to the deposit roller 14', the density of the charged developer layer, which forms on the developing roller 7' by the electric charge from the deposit roller 14', is lower, thereby resulting in a problem that a density of the developed image is lower.

SUMMARY OF THE INVENTION

An aspect of the present invention is to provide a wet electrophotographic printer having a developing unit in which a developer storing chamber communicates with an inlet of a nip between a developing roller and a metering roller, and uniformly supplies an appropriate high density liquid developer on a photosensitive body forming a visible developer image during a development.

Another aspect is to provide a wet electrophotographic printer having a developing unit in which a developer storing chamber extends longitudinally and converges toward a developer supply unit so as to prevent a generation of air bubbles or sediment due to a stagnation of a liquid developer in the developer storing chamber until after all the liquid developer is consumed to improve a quality in a developer image without a separate agitator.

Another aspect is to provide a wet electrophotographic printer having a developing unit in which a lower portion of a developing chamber has a narrow and elongated tube shape to reduce a developer stagnating volume of the developing chamber and to reduce a developer supplying capacity of a developer supply unit.

To achieve the above and/or other aspects, a wet electrophotographic printer is provided, comprising a photosensitive body to form a latent image, a developer transfer body rotates to face the photosensitive body, to transfer a liquid developer to the photosensitive body to form a visible image according to the latent image, a first developing restricting member disposed with respect to the developer transfer body to restrict at least one of an amount of toner particles of the liquid developer and a density of toner particles of the liquid developer supplied to the developer transfer body, and supply the restricted toner particles of the liquid developer into a nip between the developer transfer body and the photosensitive body, a housing divided into a developing chamber and a developer storing chamber by a partition and including the developer transfer body and the first developing restricting member, and a developer supply unit disposed below the partition in the housing to supply the liquid developer from the developer storing chamber into the developing chamber, wherein the developer transfer body and the first developing restricting member are disposed to form a border between an upper portion of the developing chamber and an upper portion of the developer storing chamber together with an upper portion of the partition.

Additional aspects and/or advantages of the invention will be set forth in part in the description which follows and, in part, will be obvious from the description, or may be learned by practice of the invention.

The upper portion of the developing chamber may be formed to communicate with an inlet of a nip between the developer transfer body and the first developing restricting member to supply the liquid developer into the nip therebetween.

The wet electrophotographic printer further comprises a second developing restricting member disposed with respect to the developer transfer body, and the upper portion of the developer storing chamber is formed to communicate with an inlet of a nip between the developer transfer body and the second developing restricting member so as to withdraw the liquid developer of the low density generated at the nip therebetween during the development, and thereby to not supply the liquid developer of the low density into the nip between the developer transfer body and the first developing restricting member.

The housing may have an elongated shape longitudinally extended to form a longitudinally elongated developing chamber and may have a longitudinally elongated developer storing chamber. Further, to reduce a longitudinal length of the housing, the developer transfer body and the first and second developing restricting members may be disposed with respect to one side of the photosensitive body.

The developer storing chamber has a lower portion having a shape in which a bottom thereof converges toward the developer supply unit positioned below the partition so as to prevent a generation of air bubbles or sediment due to a stagnation of the liquid developer until after all the liquid developer is consumed. Further, the lower portion of the developer storing chamber may be formed to have an inclined surface inclined toward the developer supply unit.

The developing chamber has a lower portion having a narrow and elongated tube shape to reduce a developer stagnating volume thereof and a developer supplying capacity of the developer supply unit.

Further, the developer supply unit is formed of a roller having a porous member such as a sponge formed at an outer surface thereof to absorb the liquid developer. Alternatively, the developer supply unit may be formed of an impeller.

The developer transfer body and the first and second developing restricting members may comprise of a developing roller, a deposit roller, and a metering roller, respectively.

The wet electrophotographic printer further comprises a photosensitive body cleaner disposed with respect to another side of the photosensitive body and is formed separately from the housing.

The photosensitive body cleaner has a cleaning blade removing a remnant of used developer from the photosensitive body, and a used developer reservoir stores the remnant of the used developer removed by the cleaning blade.

Further, the wet electrophotographic printer further comprises a laser scanning unit disposed below the photosensitive body between the housing and the photosensitive body cleaner.

BRIEF DESCRIPTION OF THE DRAWINGS

The above and/or other aspects and advantages of the invention will become apparent and more readily appreciated from the following description of the embodiment taken in conjunction with the accompanying drawings of which.

DETAILED DESCRIPTION OF THE PREFERRED EMBODIMENT

Figure 1:
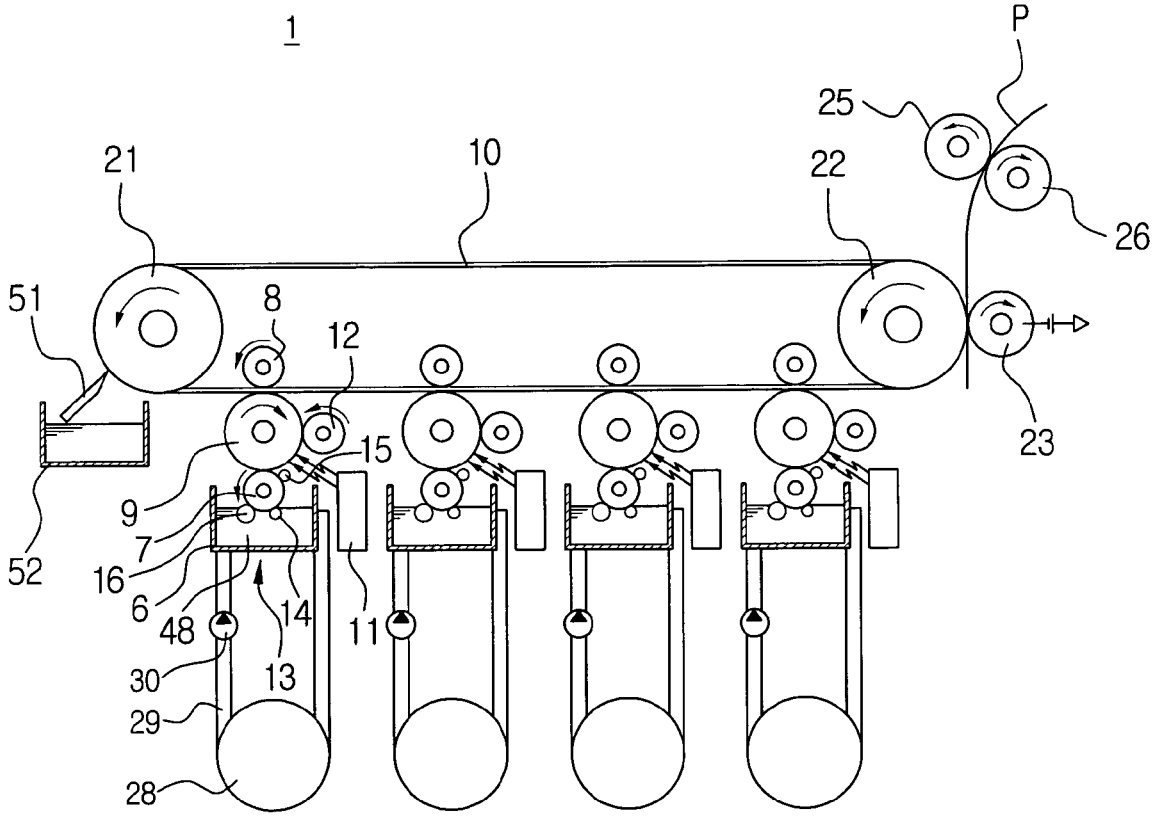
FIG. 1 (PRIOR ART)
FIG. 1 is a schematic view illustrating a conventional wet electrophotographic color printer.
Figure 2:
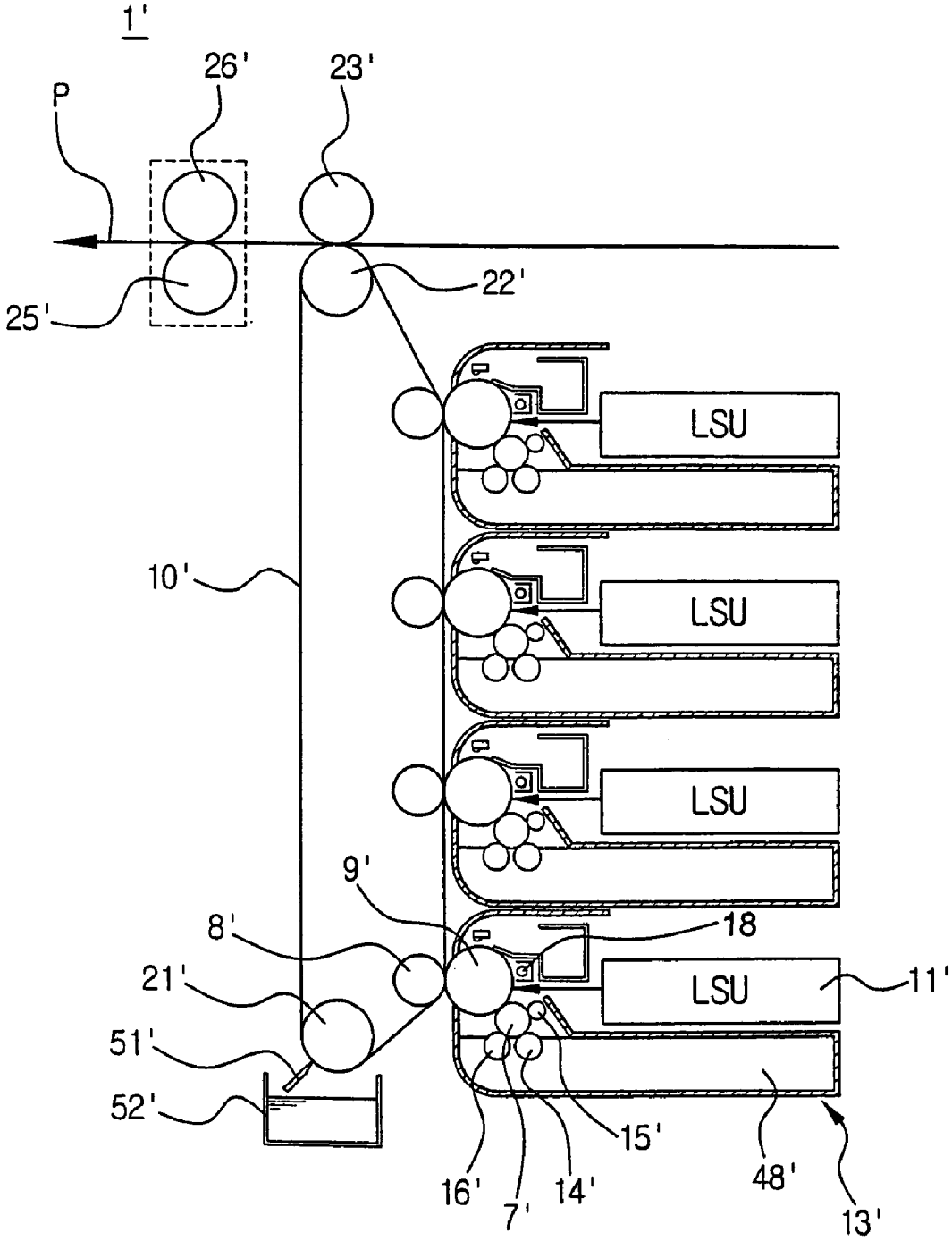
FIG.2 (PRIOR ART)
FIG. 2 is a schematic view illustrating another conventional wet electrophotographic color printer.
Figure 3:
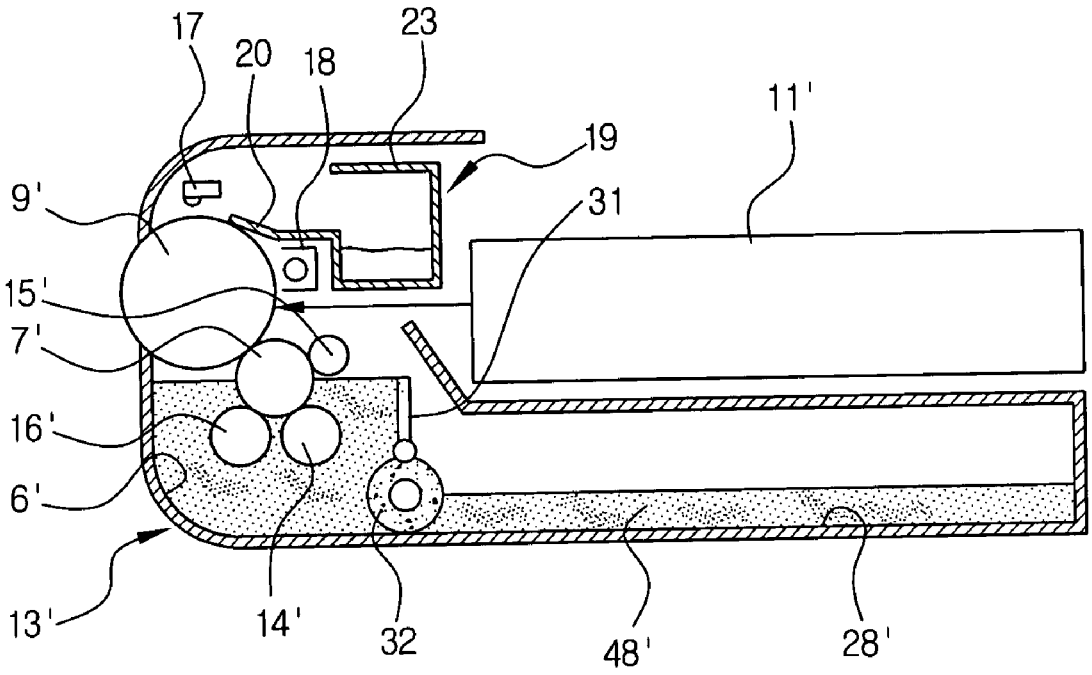
FIG.3 (PRIOR ART)
FIG. 3 is a schematic view illustrating a combined state of a photosensitive body, a developing unit, and a laser scanning unit of the wet electrophotographic color printer shown in FIG. 2.

Reference will now be made in detail to the present preferred embodiment of the present invention, examples of which are illustrated in the accompanying drawings, wherein like reference numerals refer to the like elements throughout. The embodiment is described below in order to explain the present invention by referring to the figures.

Figure 4:
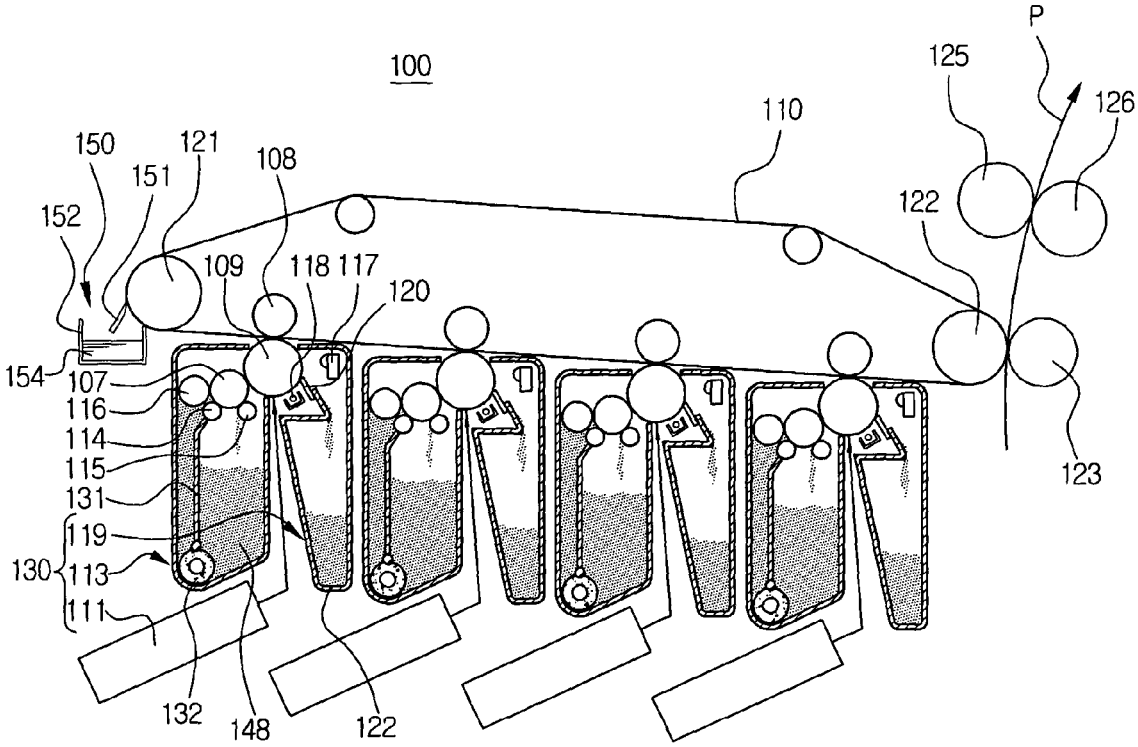
FIG. 4 is a schematic view illustrating a wet electrophotographic color printer in accordance with an embodiment of the present invention.

Referring to FIG. 4, a wet electrophotographic printer 100 is schematically illustrated in accordance with an embodiment of the present invention.

The wet electrophotographic printer 100 includes a transfer belt 110, such as a photosensitive belt, rotating in a form of a caterpillar by primary and secondary rollers 121 and 122, an image forming device 109, 130 and 108 forming a visual developer image on the transfer belt 110 according to an image signal, a transfer device 123 transferring the visual developer image formed on the transfer belt 110 onto paper P, a fixing device 125 and 126 fixing the developer image transferred onto the paper P, a transfer belt cleaning device 150 having a cleaning blade 151 to remove remnants of developer 154 including paper particles remaining on the transfer belt 110, and a used developer storing unit 152 to collect the removed remnants of developer 154 for a sequential image formation process after transferring the developer image from the transfer belt 110 onto the paper P.

A structure of a photosensitive body 109 and a first transfer roller 108 of the image forming device 109, 130 and 108, except for an image forming part 130, the transfer belt 110, the transfer device 123, the fixing device 125 and 126 and the transfer belt cleaning device 150 are substantially similar to those of the conventional wet electrophotographic printer 1 described with reference to FIG. 1, so that an explanation thereto is omitted.

For color printing, the wet electrophotographic printer 100 includes four image forming parts 130 to individually develop four colors, namely black, yellow, cyan and magenta.

Figure 5:
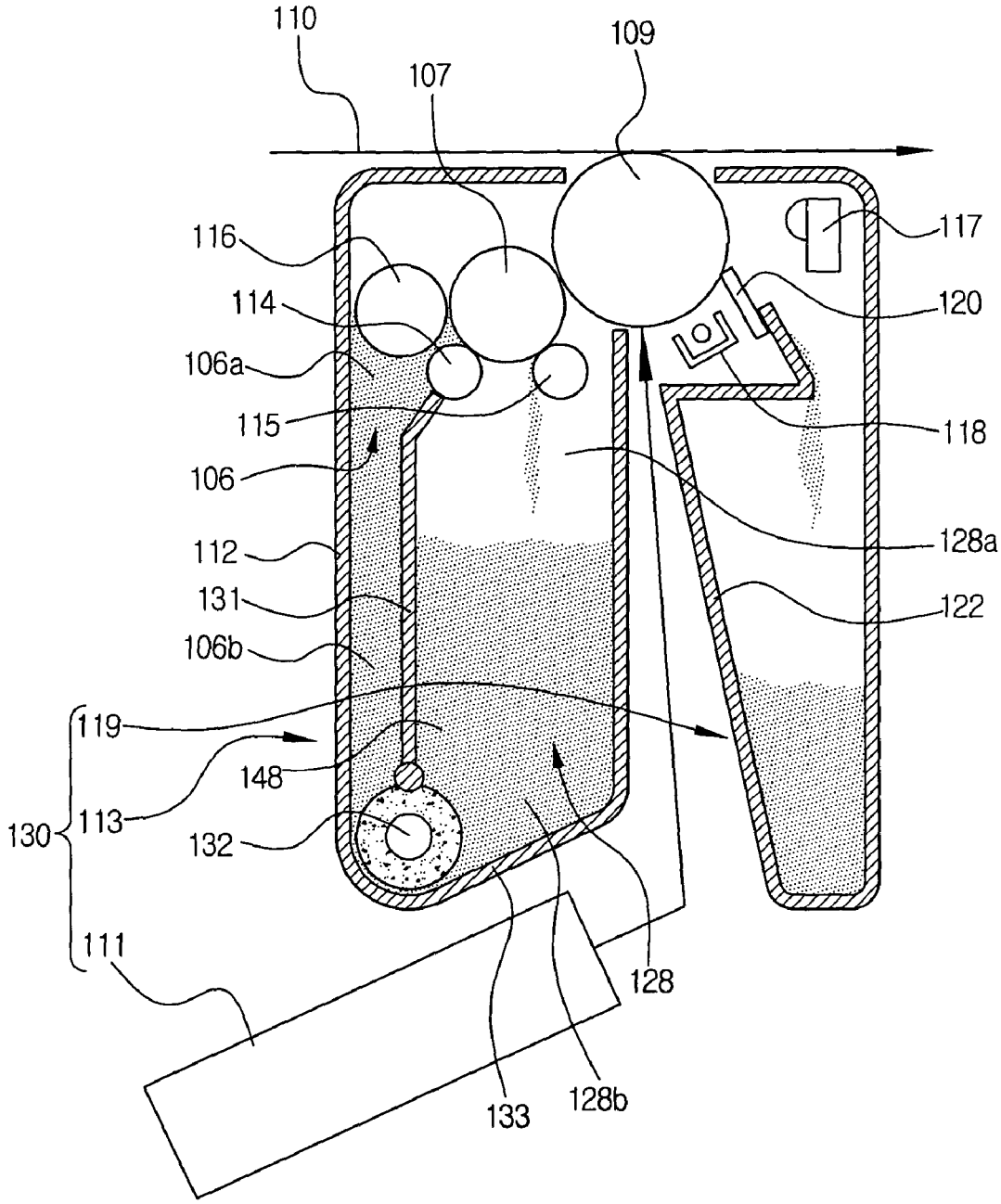
FIG. 5 is a schematic view illustrating a combined state of a photosensitive body, a developing unit, and a laser scanning unit of the wet electrophotographic color printer shown in FIG. 4.

As shown in FIG. 5, each of the image forming parts 130 comprises a developing unit 113 disposed with respect to one side, for example, a left side of the photosensitive body 109 to transfer a liquid developer 148 onto a surface of the photosensitive body 109 having an electrostatic latent image formed thereon, thereby to develop the visual developer image, a photosensitive body cleaner 119 disposed with respect to another side, for example, a right side of the photosensitive body 109 to remove used remnants of the developer remaining on the photosensitive body 109 after transferring the visual developer image from the photosensitive body 109 onto the transfer belt 110, and a laser scanning unit 111 disposed below the photosensitive body 109 between the developing unit 113 and the photosensitive body cleaner 119 to form the electrostatic latent image corresponding to an image to be printed on a surface of the photosensitive body 109 electrified by a corona charger 118.

The developing unit 113 has a developing roller 107, which rotates, and faces the photosensitive body 109 to transfer the liquid developer 148 to the photosensitive body to form the visual developer image, a deposit roller 114 transmitting an electric charge to the liquid developer 148 to form a charged developer layer having a high density, for example, of a 10–20% solid, on the developing roller 107, a metering roller 115 transmitting a predetermined voltage to the charged developer layer formed on the developing roller 107 by the deposit roller 114 to adhere a large volume of toner to the developing roller 107, and restricting the charged developer layer to have a predetermined amount or density of toner, for example, of a 20–30% solid, to be supplied into a nip between the developing roller 107 and the photosensitive body 109, a cleaning roller 116 cleaning residual liquid developer 148 remaining on the developing roller 107 after developing the photosensitive body 109, and a housing 112 divided into a developing chamber 106 and a developer storing chamber 128 by a partition 131 and including the developing roller 107, the photosensitive body 109, the liquid developer 148, the deposit roller 114, the metering roller 115 and the cleaning roller 116.

Generally, as the liquid developer 148, a liquid developer having a high density in a range of a 3–40% solid composed of a volatile liquid carrier and a powder type toner may be used.

The developing roller 107 is disposed above the developer storing chamber 128 at the left side of the photosensitive body 109 to reduce a longitudinal length of the housing 112, and the deposit roller 114 is disposed to contact with an upper portion of the partition 131 at a lower side (e.g., a lower left side) of the developing roller 107.

The metering roller 115 is disposed above the developer storing chamber 128 at another lower side (e.g., a lower right side) of the developing roller 107, and the cleaning roller 116 is disposed above the developing chamber 106 at a side of (e.g., the left side) the developing roller 107.

Accordingly, the developing roller 107, the deposit roller 114 and the upper portion of the partition 131 form a border dividing an upper portion 106*a* of the developing chamber 106 and an upper portion 128*a* of the developer storing chamber 128.

Further, the upper portion 106*a* of the developing chamber 106 communicates with an inlet of a nip between the developing roller 107 and the deposit roller 114 to supply the liquid developer 148 thereto, and the upper portion 128*a* of the developer storing chamber 128 communicates with an outlet of the nip between the developing roller 107 and the deposit roller 114 and an inlet of a nip between the developing roller 107 and the metering roller 115.

Further, in the development, the liquid developer 148 of the low density generated at the nip between the developing roller 107 and the metering roller 115 is not directly supplied to the nip between the developing roller 107 and the deposit roller 114, but is supplied after being withdrawn to the developer storing chamber 128 and mixed therein, as will be described below to supply an appropriate high density liquid developer uniformly on the photosensitive body 109.

Disposed below a lower portion of the partition 131 defining the developing chamber 106 and the developer storing chamber 128 is a developer supply unit 132 supplying the liquid developer 148 from the developer storing chamber 128 to the developing chamber 106.

The developer supply unit 132 may be formed of a porous roller having a porous member, such as a sponge formed at an outer surface thereof, in which a plurality of opened cells are formed to absorb the liquid developer 148.

Figure 6:
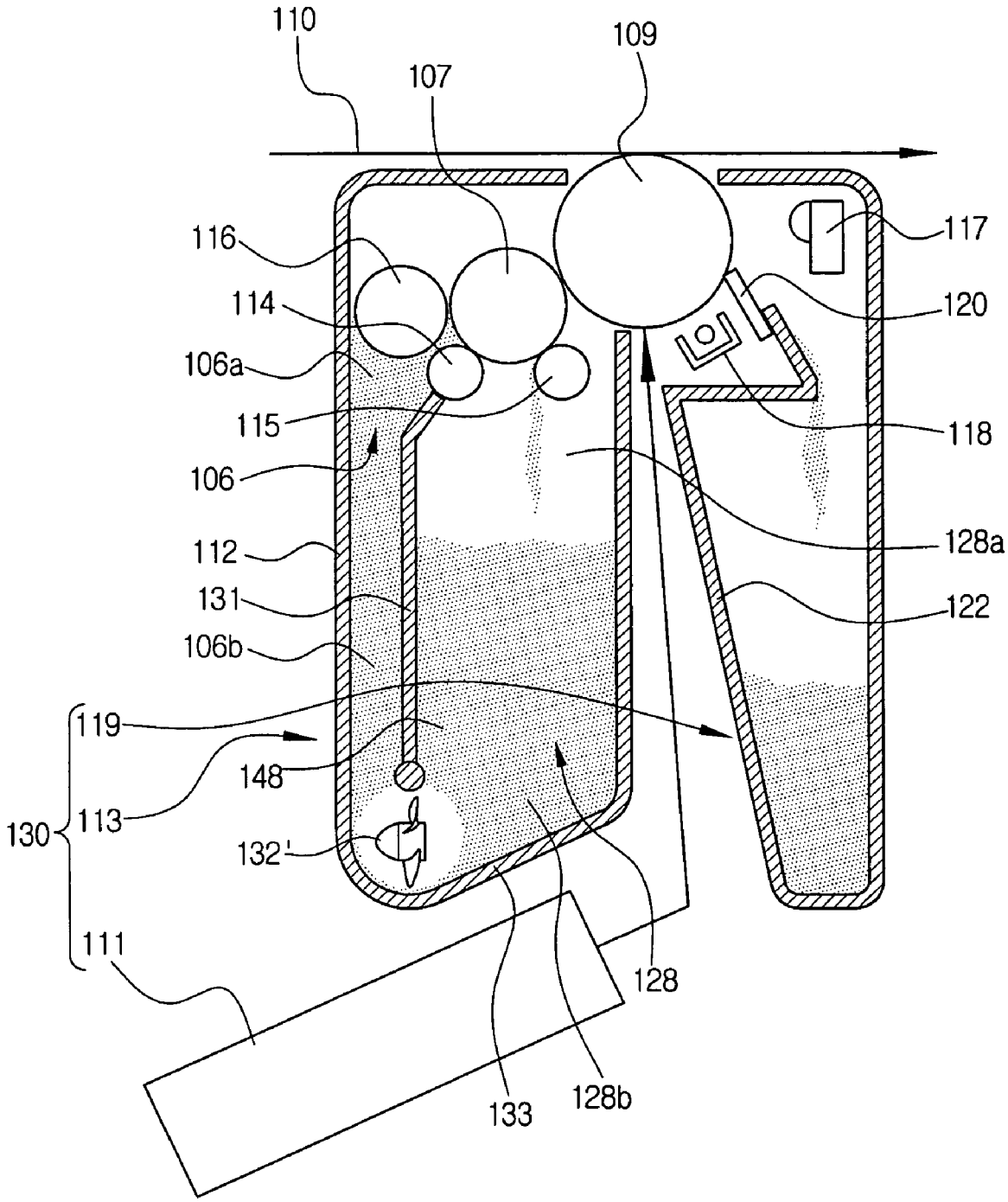
FIG. 6 is another schematic view illustrating a combined state of a photosensitive body, a developing unit, and a laser scanning unit of the wet electrophotographic color printer shown in FIG. 4.

Alternatively, the developer supply unit 132 may be formed of an impeller denoted by 132' in FIG. 6 or a pump (not shown) requiring a separate power source.

A lower portion 106*b* of the developing chamber 106, which is formed by the partition 131 positioned between the developer supply unit 132 and the upper portion 106*a* of the developing chamber 106, has a narrow and elongated tube shape to reduce a developer stagnating volume of the developing chamber 106 and a developer supplying capacity of the developer supply unit 132.

A lower portion 128*b* of the developer storing chamber 128 is constructed to have an inclined surface 133 formed at a bottom thereof, which converges toward the porous roller of the developer supply unit 132 disposed to contact with a lower round portion of the partition 131 therebelow so as to not generate air bubbles or sediment due to a stagnation of the liquid developer 148 until after all the liquid developer 148 is consumed.

The wet electrophotographic printer 100 further comprises the photosensitive body cleaner 119 disposed with respect to the other side (i.e., a right side) of the photosensitive body 109.

To facilitate a disposal of used remnants of the developer, the photosensitive body cleaner 119 is formed separately from the housing 112.

The photosensitive body cleaner 119 has a cleaning blade 120 to remove the used remnants of the developer remaining on the photosensitive body 109 after transferring the visual developer image from the photosensitive body 109 to the transfer belt 110, and a used developer reservoir 122 to store the used remnants of the developer removed by the cleaning blade 120.

Installed at an upper portion of the used developer reservoir 122 on which the cleaning blade 120 is disposed are the corona charger 118 electrifying the surface of the photosensitive body 109, and a discharger 117, such as a discharging lamp, discharging the surface of the photosensitive body 109.

Further, disposed below the photosensitive body 109 between the housing 112 of the developing unit 113 and the used developer reservoir 122 of the photosensitive body cleaner 119 is the laser scanning unit 111 to emit a laser beam onto the photosensitive body 109 according to the image signal corresponding to the image to be printed.

As described above, in the wet electrophotographic printer 100, the developer storing chamber 128 communicates with the inlet of the nip between the developing roller 107 and the metering roller 115 and has the inclined surface 133 formed at the bottom of the developer storing chamber 128, which converges toward the developer supply unit 132. Therefore, in the development, the liquid developer 148 of the low density generated at the nip between the developing roller 107 and the metering roller 115 is not directly supplied to the nip between the developing roller 107 and the deposit roller 114, but is supplied to the nip between the developing roller 107 and the deposit roller 114 after being withdrawn into the developer storing chamber 128 and mixed therein, thereby the liquid developer 148 is uniformly supplied at the appropriate high density on the photosensitive body 109.

An operation of the wet electrophotographic printer 100 in accordance with the present invention will be explained with reference to FIGS. 4 and 5.

According to a print command, when the porous roller forming the developer supply unit 132 rotates, the liquid developer 148 having the high density, for example, of a 10–20% solid, contained in the developer storing chamber 128 is absorbed by the porous roller 132 and then is moved into the lower portion 106*b* of the developing chamber 106.

Since the porous roller 132 is in compressive contact with a lower round portion of the partition 131, the liquid developer 148 absorbed by the porous roller 132 is discharged at the lower portion 106*b* of the developing chamber 106 and pumped into the upper portion 106*a* thereof.

Thus, the liquid developer 148 pumped into the upper portion 106*a* of the developing chamber 106 is formed, as the charged developer layer, on the developing roller 107 rotating at a predetermined speed due to an electric charge from the deposit roller 114, and then is formed, as the developer layer having the high density, for example, of the 20–30% solid, on the developing roller 107 due to a predetermined voltage from the metering roller 115.

Further, as the developer layer is pushed by the developing roller 107 and the metering roller 115 at the nip therebetween, the liquid developer 148 of the low density is generated, and freely falls from the inlet of the nip between the developing roller 107 and the metering roller 115. As a result, the liquid developer 148 of the low density is withdrawn into the developer storing chamber 128, since the inlet of the nip between the developing roller 107 and the metering roller 115 is positioned in the upper portion 128*a* of the developer storing chamber 128.

The liquid developer 148 of the low density withdrawn from the inlet of the nip between the developing roller 107 and the metering roller 115 into the developer storing chamber 128 is mixed with the liquid developer 148, having the high density of the 10–20% solid, contained in the developer storing chamber 128, moves toward the porous roller 132 along the inclined surface 133 formed to converge toward the porous roller 132, and then is again supplied into the upper portion 106*a* of the developing chamber 106 after being absorbed and agitated by the porous roller 132, in the same manner as described above.

Thus, while the developer layer, having the high density of the 20–30% solid, forms on the developing roller 107 by the deposit roller 114 and the metering roller 115, an electrostatic latent image corresponding to an image to be printed is formed on the photosensitive body 109 by the corona charger 118 and the laser scanning unit 111.

Thereafter, when the developing roller 107 with the developer layer having the high density of 20–30% solid formed thereon, is rotated with the photosensitive body 109, the electrostatic latent image is formed, the developer layer formed on the developing roller 107 is transferred to the electrostatic latent image formed on the photosensitive body 109 due to a difference in voltage and in electrostatic force transmitted to the photosensitive body 109 and the developing roller 107, and developed as a visual developer image.

The developer image formed on the photosensitive body 109 is transferred from the photosensitive body 109 to the transfer belt 110 due to a voltage and a pressure of the first transfer roller 108 positioned inside the transfer belt 110.

After transferring the developer image, the photosensitive body 109 is discharged by the discharging lamp 117, is cleaned by the cleaning blade 120 to remove the used remnants of the developer remaining on the photosensitive body 109, and then is again electrified by the corona charger 118 to prepare a subsequent image printing.

By contrast, as explained with reference to the wet electrophotographic printer 1 in FIG. 1, the developer image, which is transferred onto the transfer belt 10, is transferred onto the paper P as a desired image through the sequential image formation process including secondary transfer and fixation, and the remnants of the developer remaining on the transfer belt 10 are removed by the cleaning blade 51, and collected in a used developer storing unit 52.

As is apparent from the above description, the wet electrophotographic printer of the present invention can uniformly supply the appropriate high density liquid developer on the photosensitive body forming the visible image during the development by providing the developing unit in which the developer storing chamber communicates with the inlet of the nip between the developing roller and the metering roller.

Further, the wet electrophotographic printer of the present invention can improve the quality in image without a separate agitator by providing the developing unit in which the developer storing chamber extends longitudinally and converges toward the porous roller disposed therebelow so as to prevent the generation of the air bubbles or the sediment due to the stagnation of the liquid developer in the developer storing chamber until after all the liquid developer is consumed.

Further, the wet electrophotographic printer can reduce the developer stagnating volume of the developing chamber and the developer supplying capacity of the porous roller by providing the developing unit in which the lower portion of the developing chamber has the narrow and elongated tube shape.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A wet electrophotographic printer, comprising:

a photosensitive body to form a latent image;

a developer transfer body rotating to face the photosensitive body to transfer a liquid developer to the photosensitive body to form a visible image according to the latent image;

a developing restricting member disposed with respect to the developer transfer body to restrict at least one of an amount and a density of toner particles of the liquid developer supplied to the developer transfer body, and supply the at least one of the amount and the density of the toner particles into a nip between the developer transfer body and the photosensitive body;

a housing divided into a developing chamber and a developer storing chamber by a partition and containing the developer transfer body and the developing restricting member; and a developer supply unit disposed below the partition in the housing to supply the liquid developer from the developer storing chamber into the developing chamber;

wherein the developer transfer body and the developing restricting member are disposed to form a border between an upper portion of the developing chamber and an upper portion of the developer storing chamber together with an upper portion of the partition, wherein the developing restricting member is substantially in contact with the partition.

2. The printer according to claim 1, wherein the upper portion of the developing chamber communicates with an inlet of a second nip between the developer transfer body and the developing density restricting member to supply the liquid developer into the second nip therebetween.

3. The printer according to claim 1, wherein the developer supply unit comprises:

a roller having a porous member formed at an outer surface thereof to absorb the liquid developer.

4. The printer according to claim 1, wherein the developer supply unit comprises:

an impeller.

5. The printer according to claim 1, where a porous member of the roller is sponge.

6. A wet electrophotographic printer, comprising:

a photosensitive body to form a latent image;

a developer transfer body rotating to face the photosensitive body to transfer a liquid developer to the photosensitive body to form a visible image according to the latent image;

a developing restricting member disposed with respect to the developer transfer body to restrict at least one of an amount and a density of toner particles of the liquid developer supplied to the developer transfer body, and supply the at least one of the amount and the density of the toner particles into a nip between the developer transfer body and the photosensitive body;

a housing divided into a developing chamber and a developer storing chamber by a partition and containing the developer transfer body and the developing restricting member;

a developer supply unit disposed below the partition in the housing to supply the liquid developer from the developer storing chamber into the developing chamber;

wherein the developer transfer body and the developing restricting member are disposed to form a border between an upper portion of the developing chamber and an upper portion of the developer storing chamber together with an upper portion of the partition, wherein the upper portion of the developing chamber communicates with an inlet of a second nip between the developer transfer body and the developing density restricting member to supply the liquid developer into the second nip therebetween, wherein the developing restricting member is a first developing restricting member, further comprising:

a second developing density restricting member disposed with respect to the developer transfer body, and wherein the upper portion of the developer storing chamber communicates with an inlet of a third nip between the developer transfer body and the second developing density restricting member so as to withdraw the liquid developer of a low density generated at the third nip during a development, and to prevent supply of the liquid developer of the low density into the second nip between the developer transfer body and the first developing density restricting member.

7. The printer according to claim 6, wherein the housing has an elongated shape extending longitudinally to form a longitudinally elongated developing chamber and a longitudinally elongated developer storing chamber.

8. The printer according to claim 7, wherein the developer transfer body and the first and second developing density restricting members are disposed with respect to one side of the photosensitive body.

9. The printer according to claim 8, wherein the developer storing chamber comprises:

a lower portion having a shape for which a bottom converges toward the developer supply unit positioned below the partition so as to prevent a generation of air bubbles or sediment due to a stagnation of the liquid developer until after all the liquid developer is consumed.

10. The printer according to claim 9, wherein the lower portion of the developer storing chamber comprises:

an inclined surface inclined toward the developer supply unit.

11. The printer according to claim 9, wherein the developing chamber comprises:

a lower portion having a narrow and elongated tube shape to reduce a developer stagnating volume thereof and a developer supplying capacity of the developer supply unit.

12. The printer according to claim 8, further comprising:

a photosensitive body cleaner disposed with respect to a remaining side of the photosensitive body and formed separately from the housing.

13. The printer according to claim 12, wherein the photosensitive body cleaner comprises:

a cleaning blade removing a remnant of used developer from the photosensitive body; and a used developer reservoir storing the remnant of the used developer removed by the cleaning blade.

14. The printer according to claim 12, further comprising:

a laser scanning unit disposed below the photosensitive body between the housing and the photosensitive body cleaner.

15. The printer according to claim 6, wherein:

the developer transfer body comprises:

a developing roller;

the first developing restricting member comprises:

a deposit roller; and the second developing restricting member comprises:

a metering roller.

16. A wet electrophotographic printer having a housing with a photosensitive body therein to form a latent image, comprising:

a developer transfer body disposed in the housing adjacent to and facing the photosensitive body to transfer a liquid developer to the photosensitive body to form a visible image according to the latent image; and a restricting unit, at least a part of which is adjacent to and contacting with the developer transfer body to restrict toner particles of the liquid developer supplied to the transfer body, and to supply the toner particles into a nip between the developer transfer body and the photosensitive body;

wherein the housing comprises:

plural chambers separated therebetween by a boundary of a supply unit, a partition, the restricting unit, and the developer transfer body such that the supply unit supplies the liquid developer from one chamber of the housing to another chamber of the housing and the restricting unit and the developer transfer body are disposed to extend the boundary to the photosensitive body, wherein the restricting unit is substantially in contact with the partition.

17. A wet electrophotographic printer having a housing with a photosensitive body therein to form a latent image, comprising:

a developer transfer body disposed in the housing adjacent to and facing the photosensitive body to transfer a liquid developer to the photosensitive body to form a visible image according to the latent image;

wherein the housing comprises:

plural chambers separated therebetween by a boundary of a supply unit, a partition, the restricting unit, and the developer transfer body such that the supply unit supplies the liquid developer from one chamber of the housing to another chamber of the housing, a lower portion of the housing having a shape for which a bottom converges toward the supply unit positioned below the partition so as to prevent a stagnation of the liquid developer, wherein the restricting unit is substantially in contact with the partition.

18. A wet electrophotographic printer, comprising:

developing and metering rollers; a developing unit in which a developer storing chamber communicates with an inlet of a nip between the developing roller and the metering roller, and uniformly supplies a high density liquid developer on a photosensitive body forming a visible developer image during a development; and a deposit roller, wherein in the development, the liquid developer of a low density generated at a first nip between the developing roller and the metering roller is not directly supplied to a second nip between the developing roller and a deposit roller, but is supplied after being withdrawn to the developer storing chamber and mixed therein to supply the high density liquid developer uniformly on the photosensitive body.

* * * * *